US011786024B2

(12) United States Patent
Lin

(10) Patent No.: US 11,786,024 B2
(45) Date of Patent: Oct. 17, 2023

(54) MASK STORING DEVICE AND METHOD FOR STORING A MASK

(71) Applicant: Yuan-Chun Lin, Taipei (TW)

(72) Inventor: Yuan-Chun Lin, Taipei (TW)

( * ) Notice: Subject to any disclaimer, the term of this patent is extended or adjusted under 35 U.S.C. 154(b) by 0 days.

(21) Appl. No.: 17/507,333

(22) Filed: Oct. 21, 2021

(65) Prior Publication Data

US 2022/0151352 A1 May 19, 2022

(30) Foreign Application Priority Data

Oct. 21, 2020 (TW) ..... 109136497

(51) Int. Cl.
*A45C 11/00* (2006.01)

(52) U.S. Cl.
CPC ..... *A45C 11/00* (2013.01)

(58) Field of Classification Search
CPC ..... A45C 11/00; A45F 2200/05
USPC ..... 206/37, 292–299, 438, 494–495
See application file for complete search history.

(56) References Cited

U.S. PATENT DOCUMENTS 10,035,635 B2 * 7/2018 Bordeaux ..... B65D 75/20

FOREIGN PATENT DOCUMENTS

| | | | |
|---|---|---|---|
| JP | 2005137858 A | | 6/2005 |
| JP | 2011103940 A | * | 6/2011 |
| JP | 2011103940 A | | 6/2011 |
| JP | P20218704 A | * | 1/2021 |

* cited by examiner

*Primary Examiner* — Bryon P Gehman

(57) ABSTRACT

A mask storing device comprises a storing unit, a hook member, a stopper portion, a positioning member, and a flexible stopper member for storing a mask. A method to store a mask, which functions as a safe and hygienicway to allow users to store and take out the mask safely by only holding ear loops without touching the body of the mask.

18 Claims, 19 Drawing Sheets

MASK STORING DEVICE AND METHOD FOR STORING A MASK

FIELD OF THE INVENTION

The present invention relates to a mask storing device for storing a mask, and a method of storing a mask.

DESCRIPTION OF THE RELATED ART

Most of the mask storage products on the market require users to flatten the mask with both of their hands before putting the mask into the storage product, which can be inconvenient and also easy to have hands touch the mask during operation. If the mask is already used by the user but needs to be stored temporarily for subsequent use, this increases the possibility of touching the germs on the surface of the mask, and may also allow the mask to be contaminated by hands and pose a potential risk to the user's health and safety. Or the ear loops of the mask are often put into the storage product together with the body of the mask, causing the possibility of being contaminated from the contact between the ear loops and the body of the mask, or the ear loops are stored in a position where they cannot be easily taken, causing inconvenience in use. For example, Japanese Patents JPA-2011103940A and JPA-2005-137858, in order to store the mask, in addition to flattening the mask by hand, the user must open the ear loops by hand, and place each of the two ear loops upward and downward twice to place the mask into the storage case, which is inconvenient to use. In addition, the ear loop is covered or folded when it is stored, so it cannot be easily grasped, and the ear loop must be operated several times in different directions before taking out the mask, which is not easy to use. And the ear loops are stored on both sides of the storage case and extend outward also makes the storage product larger in size. In addition, the above-mentioned Japanese patent and the mask storage products on the market are designed to be used in landscape orientation, and the mask must be grasped with both hands, otherwise it is difficult to put the mask into or take out from the storage product. Such scenarios are limited since the user must place the mask storage product on a table or other places to have both hands free to operate and the storage product cannot be conveniently used in situations such as outdoors, when taking public transportation, and walking.

SUMMARY OF THE INVENTION

A mask storing device, for storing a mask, the mask storing device comprises: a storing unit, comprising an outer surface, an inner surface and a bending portion, wherein the mask can be placed on the inner surface, and a lengthwise side of the storing unit and a lengthwise edge of the mask are folded in half along the bending portion; and a hook member, located on the outer surface.

In an embodiment, a hook member is located in alignment with a bending portion, in vicinity of the bending portion, or between a widthwise side of a storing unit and the bending portion.

In an embodiment, a storing unit further comprises a movable portion, and a hook member is located at the movable portion.

In an embodiment, a mask storing device further comprising: another hook member, located on an outer surface, wherein the hook members are located on two opposite sides of a bending portion.

In an embodiment, a storing unit is folded in half and the storing unit envelops a mask body of a mask, and an ear loop of the mask is exposed on an outer surface of the storing unit and attached to a hook member.

In an embodiment, a mask storing device further comprises: a positioning member, located on a widthwise side of a storing unit, for positioning an ear hoop of a mask.

In an embodiment, a positioning member comprises a hooking notch for hooking an ear loop and positioning the ear loop.

In an embodiment, a positioning member is a protrusion, and an ear loop is hooked on two sides of the protrusion.

In an embodiment, a mask storing device further comprises: a stopper portion, located on a widthwise side of a storing unit.

In an embodiment, a mask storing device further comprises: a flexible stopper member, located on a lengthwise side of a storing unit or a bending portion or next to the bending portion, for blocking the lengthwise edge of a mask.

In an embodiment, when a flexible stopper member is at a first position, a storing unit is in an open state, and when the flexible stopper member is at a second position, the storing unit is in a closed state.

In an embodiment, a flexible stopper member is at a first position when the storing unit is in an open state, and the flexible stopper member is at a second position when the storing unit is in a closed state.

In an embodiment, a flexible stopper member comprises a first position and a second position.

In an embodiment, a flexible stopper member does not block a mask when it is at a first position, and the flexible stopper member blocks the mask when it is at a second position.

In an embodiment, a flexible stopper member transits from a first position to a second position along with a closing process of a storing unit.

In an embodiment, a flexible stopper member transits from a second position to a first position along with an opening process of the storing unit.

In an embodiment, a storing unit is folded in half along a bending portion and envelops a mask body of a mask. An ear loop of the mask is exposed on an outer surface of the storing unit, and a flexible stopper member blocks the mask body of a mask.

In an embodiment, a storing unit further comprises an outer layer and an inner layer, the inner layer being detachably attached on the outer layer.

In an embodiment, a storing unit further comprises an interspace between an inner surface and an outer surface.

A mask storing method, for storing a mask, the method comprises: holding a mask storing device in portrait orientation; holding the mask in portrait orientation; aligning a lengthwise edge of the mask with a lengthwise side of the mask storing device; placing a mask body of the mask on the mask storing device; attaching an ear hook to an attaching element of the mask storing device; and folding the lengthwise side of the mask storing device and the lengthwise edge of the mask.

In an embodiment, a storing unit comprises: a mask placement portion located on an inner surface, for placing a mask; and a handheld portion, which is next to the mask placement portion.

A mask storing device, for storing a mask, where in the mask comprises an ear loop and a lengthwise side of the mask, the mask storing device comprises: a storing unit, for storing a mask and comprises a bending portion; a flexible stopper member, located on a lengthwise side of the storing unit or the bending portion or next to the bending portion, for blocking the lengthwise edge of a mask; and a positioning member located on a side of the storing unit for positioning an ear loop of the mask.

In an embodiment, a side of a storing unit is a widthwise side of the storing unit.

In an embodiment, a positioning member comprises a hooking notch for hooking an ear loop.

In an embodiment, a hooking notch comprises a guiding notch and a fastening notch, for holding an ear loop.

In an embodiment, a mask can be placed on the inner surface, and an ear loop of the mask is exposed on an outer surface and attached to a hook member; a mask storing device has an open state and a closed state; in the open state, an inner surface and the outer surface are unfolded and the mask is in an unfolded state; in the closed state, a lengthwise side of a storing unit and a lengthwise edge of the mask are folded in half along a bending portion, the storing unit envelops a mask body of the mask, and the mask is in a folded state.

In an embodiment, a mask storing device comprises a closing component for closing a storing unit and keeping the mask storing device in a closed state.

In an embodiment, a closing component of the mask storing device comprises a magnet or magnets and magnetic material, and the mask holding device is kept in a closed state by magnetic attraction.

In an embodiment, a stopper portion comprises a flexible hinge, the stopper portion is bendable and can be bent along the flexible hinge when an external force is applied, and the stopper portion is restored to its original state while the external force is removed.

A mask storing method, in a closed state, moving an outer surface or a bending portion of a mask storing device to release a closing component of the mask storing device, and to open the mask storing device; and taking out the mask from the mask storing device after detaching an ear loop from an attaching element.

DETAILED DESCRIPTION OF THE PREFERRED EMBODIMENT

Figure 1:
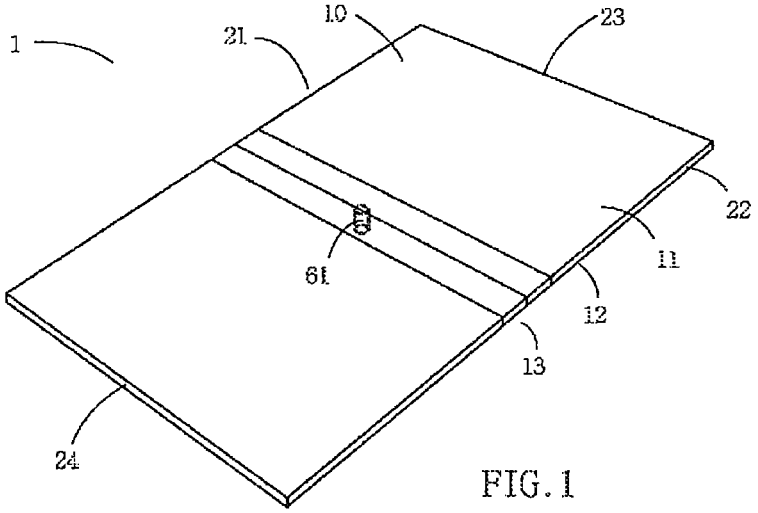
FIG. 1 provides a perspective view of the mask storing device in the open state.
Figure 1A:
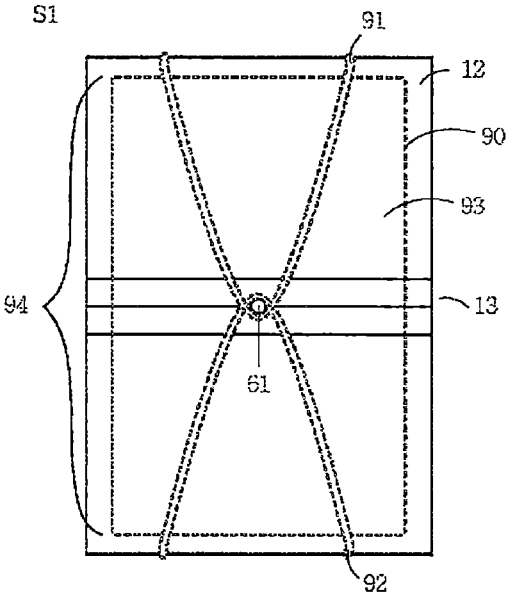
FIG. 1A provides a back view of the mask storing device in the open state.
Figure 1B:
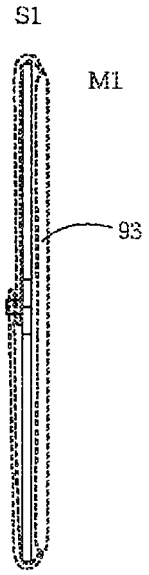
FIG. 1B provides a side view of the mask storing device in the open state.
Figure 1C:
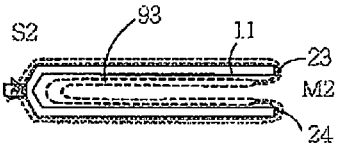
FIG. 1C provides a side view of the mask storing device in the closed state.
Figure 1D:
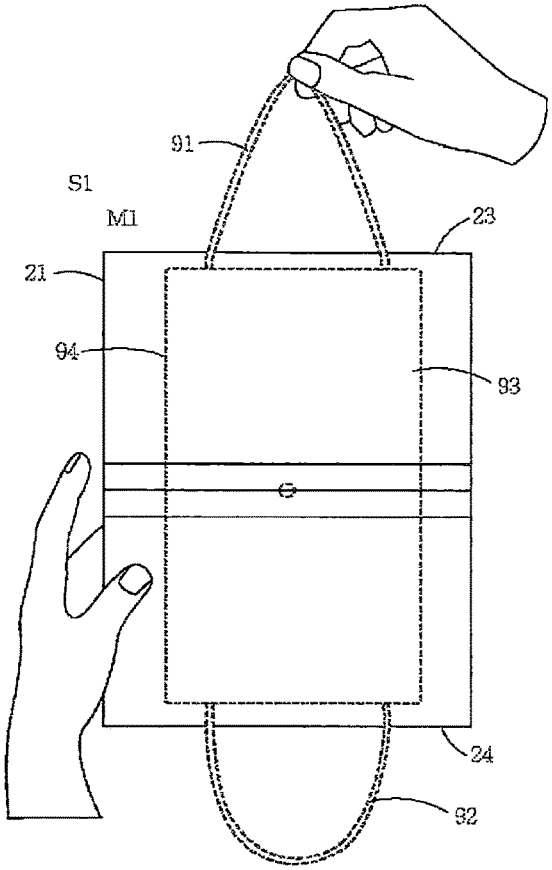
FIG. 1D~FIG. 1I are schematic drawings showing the process of the mask storing device transitions from the open state to the closed state and the method of storing a mask.
Figure 1E:
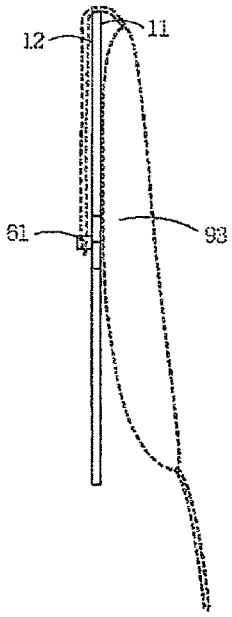
Figure 1F:
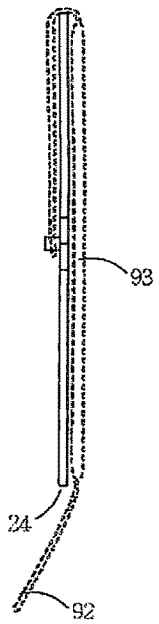
Figure 1G:
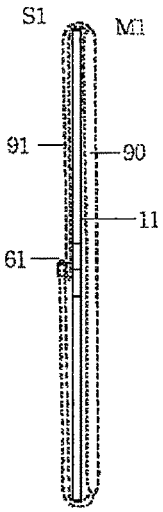
Figure 1H:
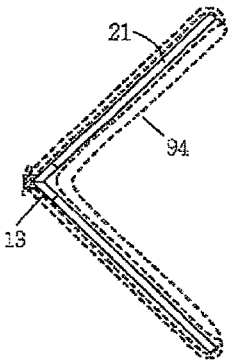
Figure 1I:
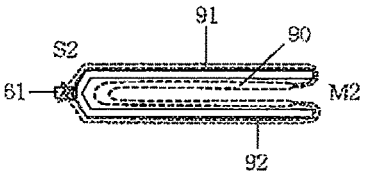

In this disclosure, the same elements will be described by the same or corresponding reference symbols. In order to make this disclosure fully understood, the following description provides detailed construction and procedures. Obviously, the implementation of this disclosure does not limit the specific details known to a technical person in the craft. The scope of this disclosure is not limited to the contents of the implementation, but is defined by the scope of the patent application.

Please refer to FIG. 1 and FIGS. 1A to 1C. A mask storing device 1 is used for storing a mask 90. The mask 90 comprises an ear loop 91, an ear loop 92, a mask body 93 and a lengthwise edge 94. The mask 90 can be in an unfolded state M1 or a folded state M2. In the unfolded state M1, the mask body 93 is flattened and unfolded; in the folded state M2, the mask body 93 is folded in half, and the lengthwise edge 94 is folded in half.

The mask storing device 1 comprises a storing unit 10 and a hook member 61. In the storing unit 10, an inner surface 11 and an outer surface 12 are formed between a lengthwise side 21, a lengthwise side 22, a widthwise side 23 and a widthwise side 24, and a bending portion 13 is formed in the central area of the inner surface 11 and the outer surface 12. The lengthwise side 21 corresponds to the lengthwise side 22, the widthwise side 23 corresponds to the widthwise side 24, and the two sides of the widthwise side 23 and the widthwise side 24 are connected to the two sides of the lengthwise side 21 and the lengthwise side 22 respectively. The mask storing device 1 may be in an open state S1 or a closed state S2. The inner surface 11 is used for placing the mask 90. In the open state S1 (FIGS. 1, 1A, 1B), the inner surface 11 and the outer surface 12 are unfolded, the inner surface 11 is flattened, for example, completely flattened to 180 degrees, the storing unit 10 is flattened, and the widthwise side 23 and the widthwise side 24 are located at the two ends of the storing unit 10; in the closed state S2 (FIG. 1C), the inner surface 11 and the outer surface 12 are bent along the bending portion 13, the lengthwise side 21 and the lengthwise side 22 are bent along the bending portion 13, and the widthwise side 23 is close to widthwise side 24.

The hook member 61 is an attaching element and is located on the outer surface 12 for attaching the ear loop 91 and the ear loop 92 so that the ear loop 91 and the ear loop 92 can be hooked on the hook member 61. For example, the hook member 61 can be a raised cylinder, and the hook member 61 is in alignment with the bending portion 13.

whereby, the mask 90 can be placed on the inner surface 11. The lengthwise side 21 and the lengthwise side 22 of the mask storing device 1, the mask body 93 and the lengthwise edge 94 of the mask 90 can be folded in half along the bending portion 13, and the ear loop 91 and the ear loop 92 can be hooked onto the hook member 61. The inner surface 11 envelops the mask body 93 of the mask 90 when the storing unit 10 is folded in half.

Please refer to FIG. 1D~1I. In the open state S1, the user can grab the lengthwise side 21 of the storing unit 10 with one hand to hold the mask storing device 1 upright (as in FIG. 1D), so that the storing unit 10 is in portrait orientation instead of landscape orientation, for example, with the widthwise side 24 is close to the user and the other widthwise side 23 away from the user, and the inner surface 11 spread open and flattened, so that the space for placing the mask 90 becomes larger for the user to place the mask 90 on the inner surface 11. The user can grab the ear loop 91 of the mask 90 with another hand, allowing the mask body 93 to hang down naturally in the portrait orientation so that the lengthwise edge 94 of the mask 90 is aligned with the lengthwise side 21 of the mask storing device 1, and place the mask body 93 on the mask storing device 1 (as in FIG. 1D). And the user can pull the ear loop 91 toward the outer surface 12 to attach the ear loop 91 on the hook member 61, so that the mask body 93 hangs on the inner surface 11 (as in FIG. 1E), and then the user can grab the ear loop 92, pull the ear loop 92 and the mask body 93 toward the widthwise side 24, so that the mask body 93 is flattened and the mask 90 is transitioned to the unfolded state M1 (as in FIG. 1F), followed by attaching the ear loop 92 on the hook member 61, so that the mask 90 is attached in the appropriate position on the inner surface 11 and maintains the unfolded state M1 (as in FIG. 1G). With the above operation method, the user only needs to grab the ear loop 91 and the ear loop 92 to easily flatten the mask 90 and fasten it on the mask storing device 1 without handling the mask body 93 by hand, eliminating hand contact with the inner and outer surfaces of the mask body 93.

When the mask 90 is fixed on the inner surface 11, the user can fold the lengthwise side 21 of the mask storing device 1 and the lengthwise edge 94 of the mask 90 along the bending portion 13 (as in FIG. 1H), so that the mask storing device 1 is transitioned from the open state S1 to the closed state S2, and the mask 90 is transitioned from the unfolded state M1 to the folded state M2 to reduce the size, which makes it more convenient for the user to carry. The ear loop 91 and the ear loop 92 are exposed on the storing unit 10 and hooked on the hook member 61 on the outer surface 12 in the closed state S2 (see FIG. 1I).

Figure 1J:
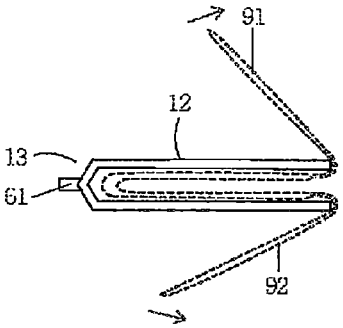
FIG. 1J~FIG. 1K are schematic drawings showing the method of taking out a mask from the mask storing device.
Figure 1K:
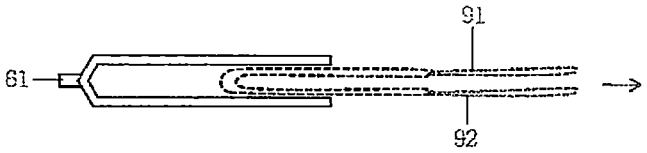

When the user wants to access the mask 90, since the ear loop 91 and ear loop 92 are exposed on the outer surface 12 and hooked on the hook member 61 (as in FIG. 1I), with the hook member 61 located on the bending part 13, the ear loop 91 and ear loop 92 are widely exposed on the outer surface 12, such that the user can grab the ear loop 91 and ear loop 92 directly to remove them from the hook member 61 easily (as in FIG. 1J), then the mask 90 can be easily taken out (as in FIG. 1K), and the mask 90 can be opened directly for use, avoiding touching the mask body 93 by hand to reduce the risk of contaminating the mask 90 or touching germs.

Conventional mask storage products are used in landscape orientation and are difficult to put the mask 90 on the mask storing device 1. When in use, the mask storage product needs to be placed on the table, and the user has to flatten the mask with both hands and then put it into the storage product, which is inconvenient and it's easy to touch the mask body 93 during the operation. The method of the present invention is operated by grabbing the ear loop 91, so that the user does not need to touch the mask body 93, along with the feature that the mask 90 hangs down naturally when grabbing the ear loop 91, the mask storing device 1 is designed to be used upright in portrait orientation so that the mask storing device 1 and the mask 90 is coordinately matched. The user can use this method to conveniently store the mask 90 even when standing or outdoors. It is also easy to take the mask 90 out when needed, so that it can be used on more occasions with greatly enhanced convenience and hygiene.

The mask 90 can be a mask that has been used by the user but needs to be temporarily stored for subsequent use. By using the mask storing device 1 and the above-mentioned method, the probability of touching the germs on the surfaces of the mask body 93 can not only be greatly reduced, along with avoiding contamination of the mask body 93. This keeps the mask 90 clean and protects the health of the user.

Figure 1L:
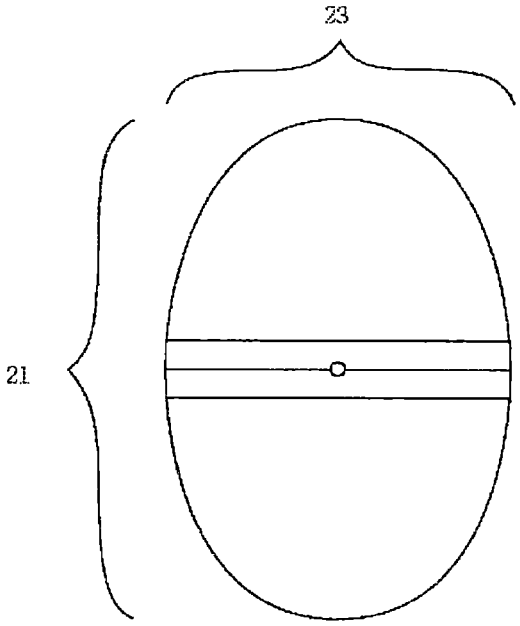
FIG. 1L~FIG. 1N are schematic drawings showing different appearances of the storing unit of the mask storing device.
Figure 1M:
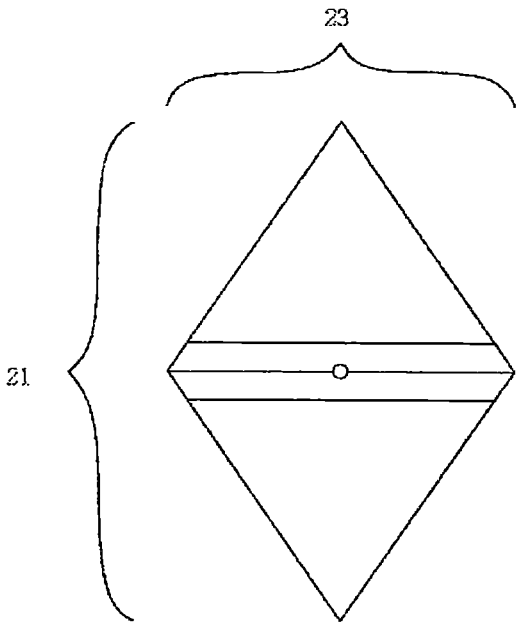
Figure 1N:
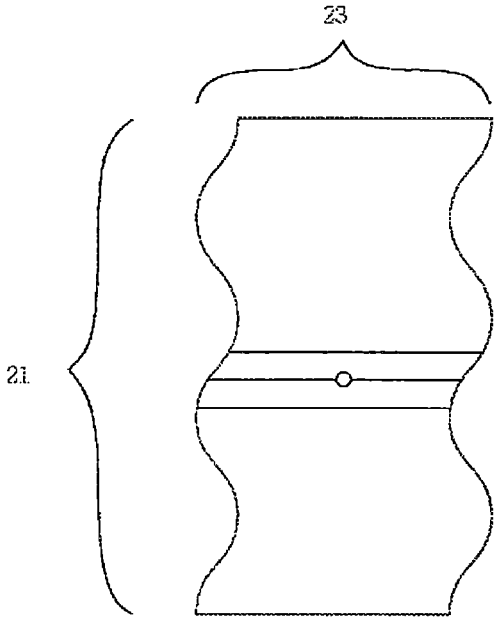

Alternatively, the shape of the storing unit 10 can be oval, diamond, irregular curve, etc. (FIG. 1L~1N), in which case the lengthwise side 21 refers to the longer side of the shape and the widthwise side 23 refers to the shorter side of the shape.

Please refer to FIGS. 2 and 2A to 2C, where the mask storing device 1*a* further comprises a stopper portion 31 and a stopper portion 32, a positioning member 41 and a positioning member 42, a pair of flexible stopper member 50, and a hook member 61*a* and a hook member 62*a*.

The stopper portion 31 is located on the widthwise side 23 and the stopper portion 32 is located on the widthwise side 24 to block the widthwise edge of the mask body 93 so that the mask body 93 will not protrude from the mask storing device 1*a* and can be used as a support when folding the mask 90 for easier operation. The stopper portion 31 is a wall and the stopper portion 32 is a wall in this embodiment.

The positioning member 41 is located on the widthwise side 23, the positioning member 42 is located on the widthwise side 24. The positioning member 41 comprises hooking notch 411, hooking notch 412, the positioning member 42 comprises hooking notch 421, hooking notch 422. The hooking notch 411, hooking notch 412 are located on both sides of the positioning member 41, the hooking notch 421, and hooking notch 422 are located on both sides of the positioning member 42. For example, the positioning member 41 is a protrusion and the positioning member 42 is a protrusion for guiding the ear loop 91 and the ear loop 92 to be opened and in position, and the hooking notch 411, the hooking notch 412, the hooking notch 421, and the hooking notch 422 are used to hook the ear loop 91 and the ear loop 92 to position the mask 90 in the appropriate position. The positioning member 41 is located on the stopper portion 31 and the positioning member 42 is located on the stopper portion 32.

The flexible stopper member 50 is located on the lengthwise side 21 or the lengthwise side 22 to block the central area of the lengthwise edge 94 of the mask 90. In this embodiment, there may be two flexible stopper member 50, which are respectively located on lengthwise side 21 and lengthwise side 22.

The hook member 61*a* and the hook member 62*a* are attaching elements and are located on the outer surface 12 for attaching the ear hook 91 and the ear hook 92, and the ear hook 91 and the ear hook 92 can be hooked on the hook member 61*a* and the hook member 62*a*. The hook member 61*a* and the hook member 62*a* are raised cylinders and are located on opposite sides near the bending portion 13, the hook member 61*a* is located between the widthwise side 23 and the bending portion 13, and the hook member 62*a* is located between the widthwise side 24 and the bending portion 13.

By the above-mentioned construction, the mask 90 can be placed on the inner surface 11, the mask body 93 and the lengthwise edge 94 of the mask 90 and the storing device 1*a* can be folded in half along the bending portion 13, and the ear loop 91 and the ear loop 92 can be hooked on the hook member 61*a* and the hook member 62*a*.

Figure 2:
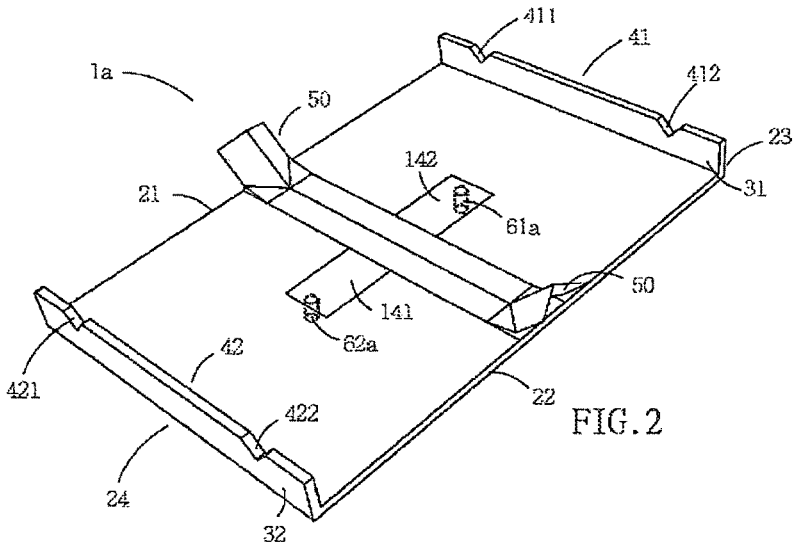
FIG. 2 provides a perspective view of the mask storing device in the open state.
Figure 2A:
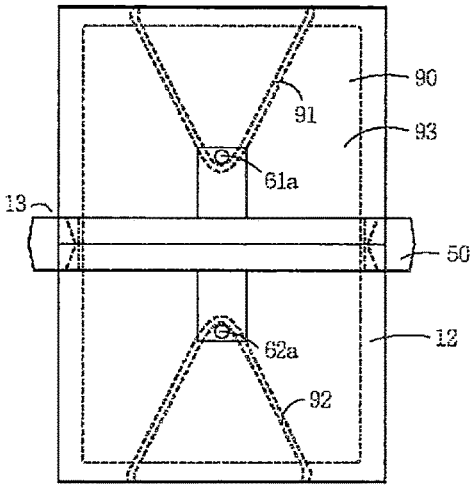
FIG. 2A provides a back view of the mask storing device in the open state.
Figure 2B:
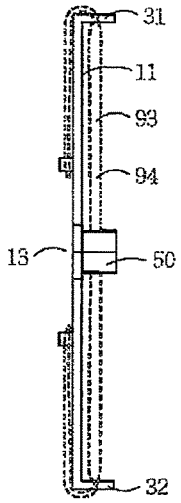
FIG. 2B provides a side view of the mask storing device in the open state.
Figure 2C:
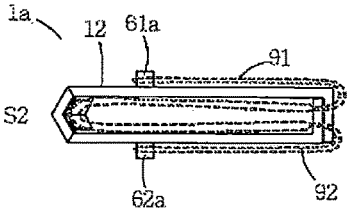
FIG. 2C provides a side view of the mask storing device in the closed state.
Figure 2D:
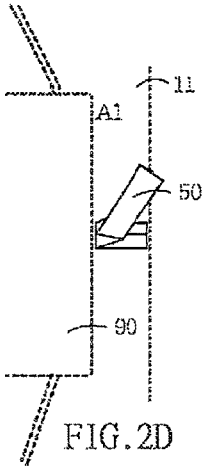
FIG. 2D~FIG. 2F are schematic drawings showing the positions of the flexible stopper member of the mask storing device.
Figure 2E:
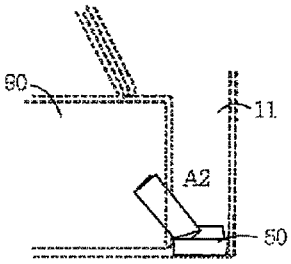
Figure 2F:
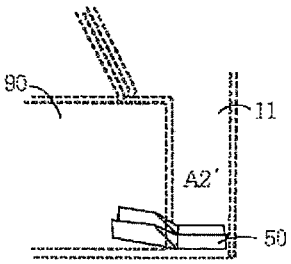
Figure 2G:
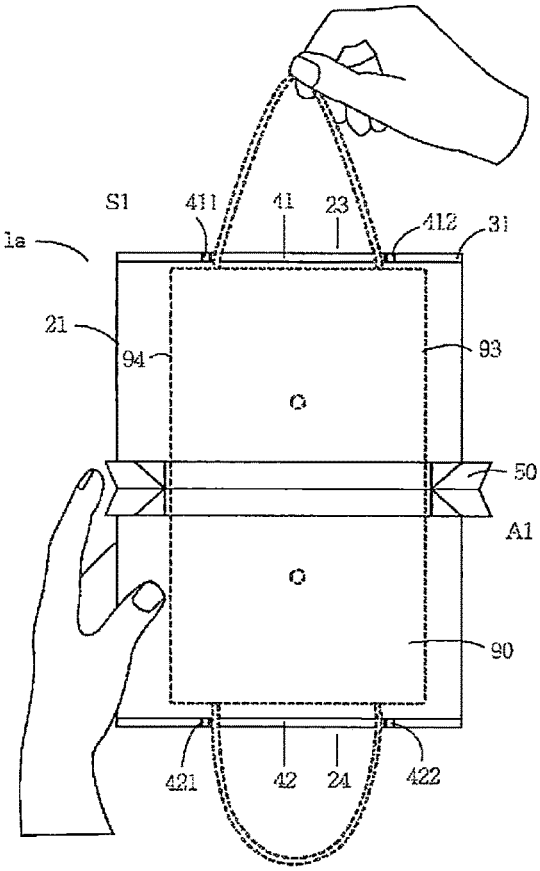
FIG. 2G~FIG. 2L are schematic drawings showing the process of the mask storing device transitions from the open state to the closed state and the method of storing a mask.

Please refer to FIGS. 2D to 2F, the flexible stopper member 50 may be an origami structure, which comprises positions A1, A2 and A2'. In the position A1, the flexible stopper member 50 is away from the inner surface 11 and the flexible stopper member 50 does not block or press the mask 90 in the direction normal to the inner surface 11 (as in FIG. 2D), which does not hinder the removal or insertion of the mask 90; in the position A2, the flexible stopper member 50 is closer to the inner surface 11 and the flexible stopper member 50 blocks or presses the mask 90 in the direction normal to the inner surface 11 (as in FIG. 2E), which prevents the mask 90 from falling out of the mask storing device 1*a*; The flexible stopper member 50 is closer to the inner surface 11 in the position A2' than in the position A2 and can more tightly block or even hold the mask 90 (as in FIG. 2F).

Figure 2H:
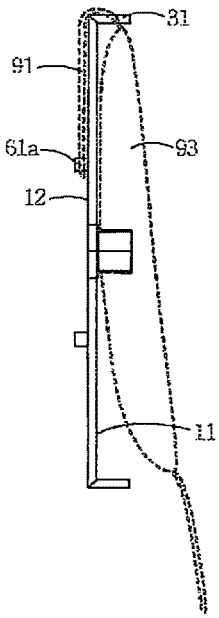
Figure 2I:
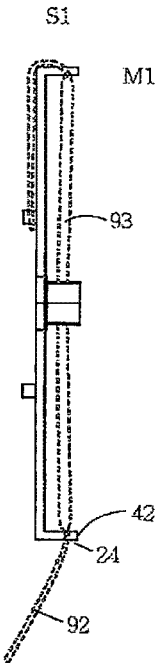
Figure 2J:
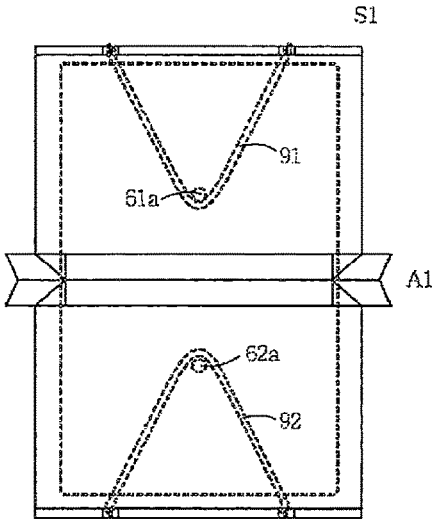
Figure 2K:
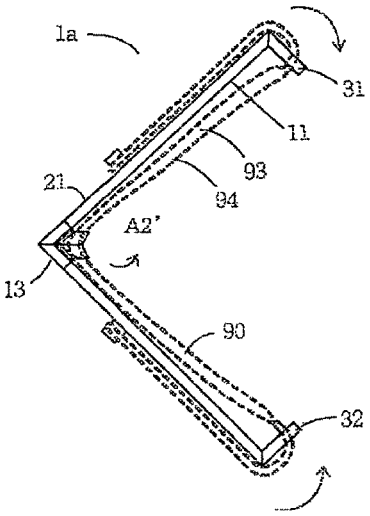

Please refer to FIG. 2G~2L. FIG. 2G~2L are schematic drawings showing the process of transitioning the mask storing device 1*a* from the open state S1 to the closed state S2 and the mask storing method. In the open state S1, the flexible stopper member 50 is in the position A1, the user can grab the lengthwise side 21 with one hand and make the widthwise side 24 close to the user, with the other widthwise side 23 away from the user and hold the mask storing device 1*a* upright in portrait orientation and flatten the inner surface 11 for placing the mask 90 (as in FIG. 2G). And the user can grab the ear loop 91 of the mask 90 with another hand, so that the mask body 93 is in portrait orientation and hangs down naturally, which makes the lengthwise edge 94 of the mask 90 align with the lengthwise side 21 of the mask storing device 1*a*, and the mask body 93 is placed on the mask storing device 1*a*. Then the mask body 93 is brought closer to the stopper portion 31 so that the widthwise edge of the mask body 93 is against the stopper portion 31, and the stopper portion 31 can be used as a support for the user to pull the ear loop 91 towards the outer surface 12, allowing the ear loop 91 to be opened with the guidance of the positioning member 41 and hooked on the two sides of the positioning member 41. The hooking notch 411 and the hooking notch 412 can secure the ear loop 91 and position the mask body 93 at the appropriate position on the inner surface 11. (as in FIG. 2G) The user can then fasten the ear loop 91 on the hook member 61*a*, so that the mask body 93 hangs on the inner surface 11 (as shown in FIG. 2H), and the user can grab the ear loop 92 and pull the ear loop 92 and the mask body 93 towards the widthwise side 24, so the mask body 93 can be flattened and the mask 90 is transitioned into the unfolded state M1 (as shown in FIG. 2I). Then the ear loop 92 can be opened and positioned in the hooking notch 421 and the hooking notch 422 by the guidance of the positioning member 42 and hooked on the hook member 62*a*, so that the mask 90 is secured at the appropriate position on the inner surface 11 and remains in the unfolded state M1 (as in FIG. 2J). By the above-mentioned method, the user only needs to grab the ear loop 91 and the ear loop 92 to easily flatten and fasten the mask 90 to the mask storing device 1*a* without grabbing the mask body 93, avoiding touching the inner and outer surface of the mask body 93 by hand.

Figure 2L:
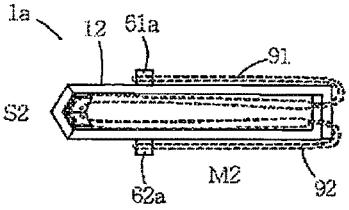

When the mask 90 is attached to the inner surface 11, the user can press down the flexible stopper member 50 by hand, so that the flexible stopper member 50 transitions from the position A1 to the position A2' and blocks or presses the mask 90 so that the mask 90 will not lift up during the closing process and can prevent the user from directly touching the mask body 93. Then the user can fold the lengthwise side 21 of the mask storing device 1*a* and the lengthwise edge 94 of the mask 90 in half along the bending portion 13 (as in FIG. 2K), so that the mask storing device 1*a* transitions from the open state S1 to the closed state S2. The storing unit 10*a* is folded in half, the inner surface 11 envelopes the mask body 93 of the mask 90, and the mask 90 is transitioned from the unfolded state M1 to the folded state M2 and the size is reduced, which is more convenient for the user to carry. The ear loop 91 and the ear loop 92 are exposed on the storing unit 10 and hooked on the hook member 61 on the outer surface 12 in the closed state S2 (FIG. 2L). In the process of transitioning the mask storing device 1*a* from the open state S1 to the closed state S2, the stopper portion 31 and the stopper portion 32 can limit the displacement of the mask body 93 so that it will not detach or protrude from the mask storing device 1*a*.

Figure 2M:
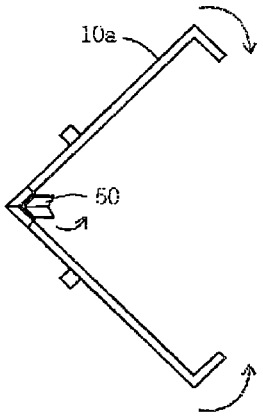
FIG. 2M~FIG. 2N are schematic drawings showing the flexible stopper member transitions along with the opening and closing process of the storing unit.
Figure 2N:
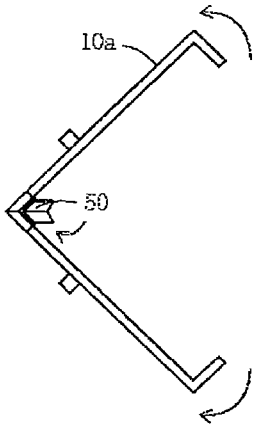

In addition, as shown in FIG. 2M and FIG. 2N, even if the user does not press down the flexible stopper member 50, the flexible stopper member 50 is still driven by the opening and the closing process of the storing unit 10*a* and is transitioned from the position A1 to the position A2 while the storing unit 10*a* transitions between the open state S1 and the closed state S2. The user can choose to press the flexible stopper member 50 by hand or let the flexible stopper member 50 automatically switch positions to fasten the mask 90 depending on factors such as the ease of folding the mask. Conversely, when the storing unit 10*a* transitions from the closed state S2 to the open state S1, the flexible stopper member 50 may transition from the position A2 or the position A2' to the position A1, so that the user can easily place the mask 90 on the inner surface 11 in the open state S1 without being blocked by the flexible stopper member 50.

Figure 2O:
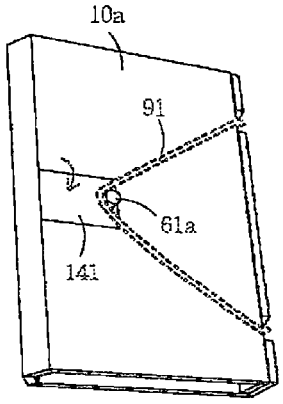
FIG. 2O~FIG. 2P are schematic drawings showing the movable portion of the mask storing device is activated and the ear loop is detached from the hook member.
Figure 2P:
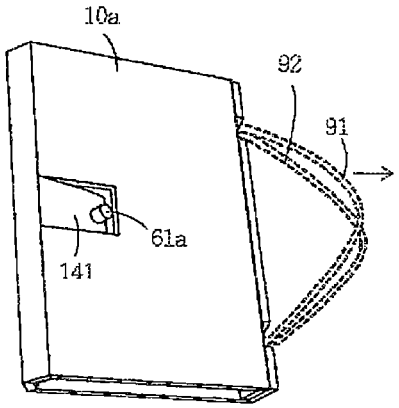

Please refer to FIGS. 2O~2P, the storing unit 10*a* comprises a movable portion 141 and a movable portion 142 (as in FIG. 2). For example, one side of the movable portion 141 and 142 is connected to the body of the storing unit 10*a*, and the other side of the movable portion 141 and 142 are not connected to the body of the storing unit 10*a*, so the movable portion 141 and 142 can act like a cantilever. The hook member 61*a* is located on the movable portion 141, and the hook member 62*a* is located on the movable portion 142. When the ear loop 91 and the ear loop 92 attaches to the hook member 61*a* and the hook member 62*a*, the user can press and activate the movable portion 141 and the movable portion 142, so that the hook member 61*a* and 62*a* move relative to the outer surface 12 and toward the inner surface 11, allowing the ear loop 91 and 92 to detach from the hook member 61*a* and 62*a*. Therefore, the user does not need to remove the ear loop 91 and the ear loop 92 from the hook member 61*a* and 62*a* by hand and can easily grab the ear loop 91 and the ear loop 92 at the same time, taking out and wearing the mask 90 quickly and conveniently to protect the user immediately.

Figure 2Q:
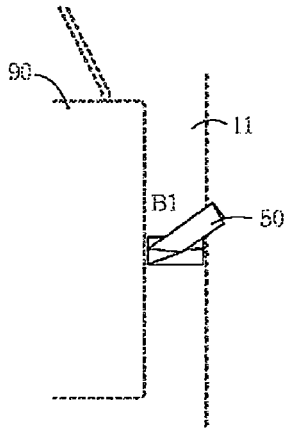
FIG. 2Q~FIG. 2S are schematic drawings showing the position of the flexible stopper may vary according to different designs.
Figure 2R:
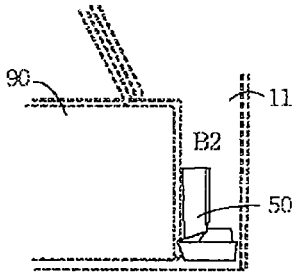
Figure 2S:
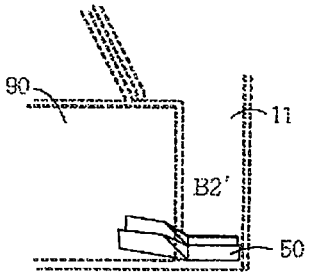

In addition, the design of the flexible stopper member 50 can be adjusted and make it able to be in different positions. For example, the position B1 of the flexible stopper member 50 in FIG. 2Q is further away from the inner surface 11, so that the mask 90 will not be blocked when placed into it. The position B2 in FIG. 2R is approximately perpendicular to the inner surface 11, although not directly pressing the mask 90, it can also achieve the effect of limiting the outward displacement of the mask body 93 so that the mask 90 will not be separated from the mask storing device 1*a* while the position B2' in FIG. 2S is close to the inner surface 11 and can more tightly block or suppress the mask 90.

Figure 2T:
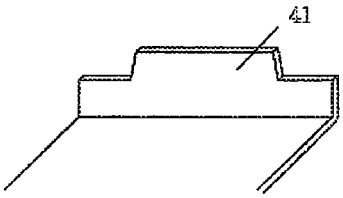
FIG. 2T~FIG. 2U are schematic drawings showing different forms of the positioning member of the mask storing device.
Figure 2U:
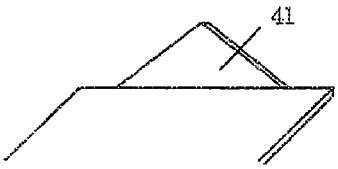

Please refer to FIGS. 2T~2U, the positioning member 41 may be in other forms, such as a trapezoidal or a triangular structure without the hooking notch 411 and the hooking notch 412, as long as the design and the structure of the positioning member 41 can achieve the purpose of guiding the ear loop 91 and the ear loop 92 to be opened and in position as well as securing the position of the mask body 93.

Figure 2V:
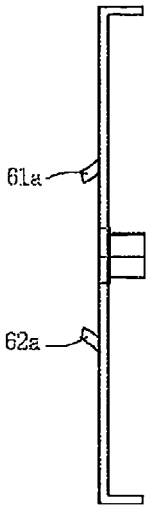
FIG. 2V~FIG. 2W are schematic drawings showing different forms of the hook member of the mask storing device.
Figure 2W:
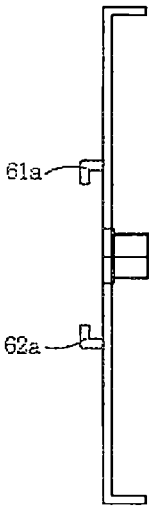

In addition, the form, structure and shape of the hook member 61*a* and the hook member 62*a* are not limited to the above-mentioned designs, as long as the effect of attaching the ear loop 91 and the ear loop 92 can be achieved, for example, it could be an upward extension of the outer surface 12 (FIG. 2V) or an inverted hook. (FIG. 2W).

Figure 3:
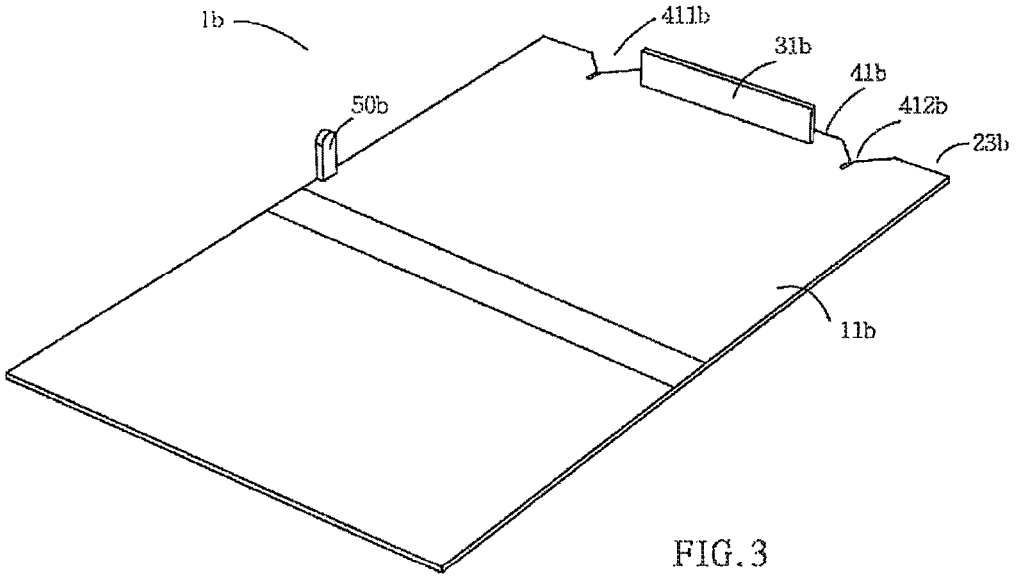
FIG. 3 provides a perspective view of the mask storing device in the open state.
Figure 3A:
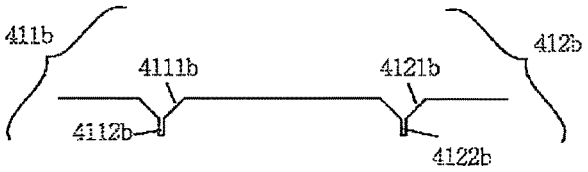
FIG. 3A is a drawing of partial enlargement of the positioning member of the mask storing device.
Figure 3B:
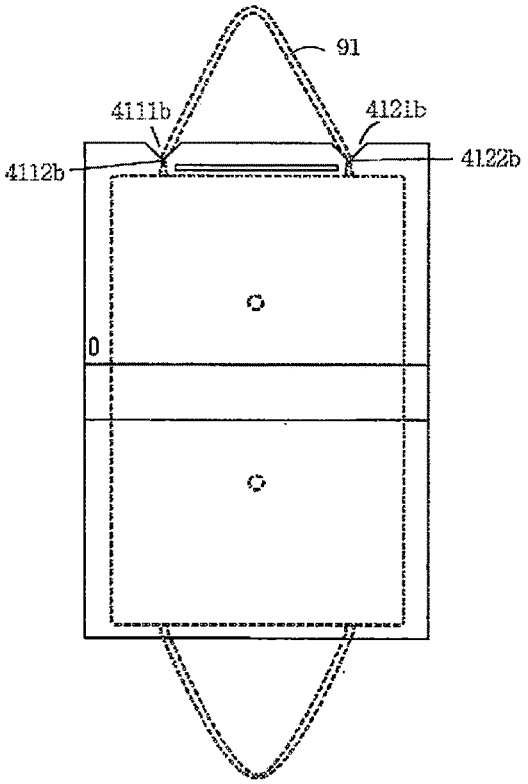
FIG. 3B~FIG. 3E are schematic drawings showing the process of the mask storing device transitions from the open state to the closed state and the method of storing a mask.
Figure 3C:
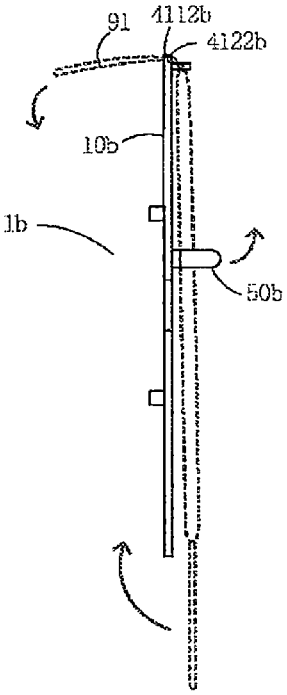
Figure 3D:
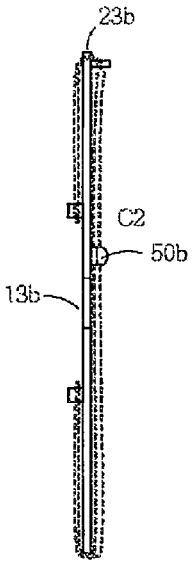
Figure 3E:
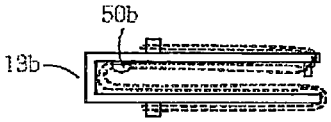

Please refer to FIG. 3 and FIGS. 3A~3E, the mask storing device 1*b* comprises a positioning member 41*b*, a stopper portion 31*b*, and a flexible stopper member 50*b*. The stopper portion 31*b* may be a raised block on the inner surface 11*b*, the positioning member 41*b* is located on the widthwise side 23*b*, the hooking notch 411*b*, the hooking notch 412*b* further comprise a guiding notch 4111*b*, a guiding notch 4121*b*, a guiding notch 4112*b*, and a guiding notch 4122*b* (FIG. 3A). When the user positions the ear loop 91 to the hooking notch 411*b* and the hooking notch 412*b* on both sides of the positioning member 41*b*, the guiding notch 4111*b* and the guiding notch 4121*b* can guide the ear loop 91 to the position of the fastening notch 4112*b* and the fastening notch 4122*b* (as in FIG. 3B). As the width of the fastening notch 4112*b* and the fastening notch 4122*b* is narrower, the user can pull the ear loop 91 into the fastening notch 4112*b* and fastening notch 4122*b* and make the ear loop 91 be clamped and secured by the fastening notch 4112*b* and the fastening notch 4122*b* (as in FIG. 3C), so that the ear loop 91 will not be easily detached from the mask storing device 1*b*. Then the ear loop 91 and the ear loop 92 can be fastened and the storing unit 10*b* can be bent together with the mask 90 along the bending portion 13.

Figure 3F:
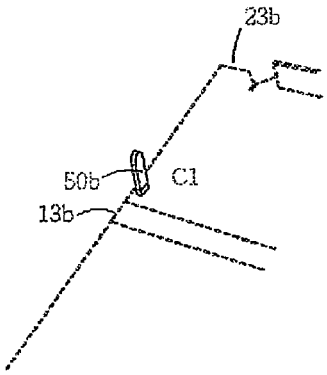
FIG. 3F~FIG. 3G are schematic drawings showing the positions of the flexible stopper member of the mask storing device.
Figure 3G:
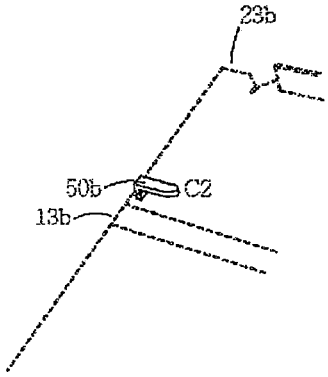

Please refer to FIGS. 3F~3G. The flexible stopper member 50*b* may be a flexible material, and is located between the bending portion 13*b* and the widthwise side 23*b* near the bending portion 13*b*. The flexible stopper member 50*b* transitions from the position C1 to the position C2 to block the mask 90.

Figure 3H:
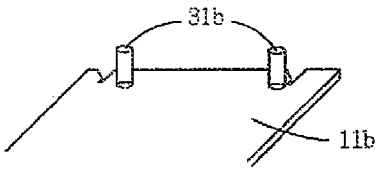
FIG. 3H is a schematic drawing showing different forms of the stopper member of the mask storing device.

In addition, the stopper portion 31*b* can also be in other forms, and its shape and number are not limited, as long as the function of stopping the widthwise edge of the mask 90 can be achieved, such as the two cylinders protruding from the inner surface 11*b* shown in FIG. 3H.

Figure 4:
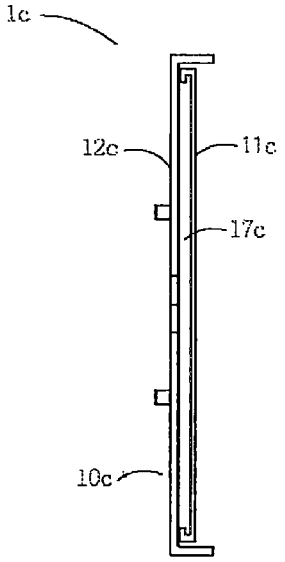
FIG. 4 provides a side view of the mask storing device in the open state.
Figure 4A:
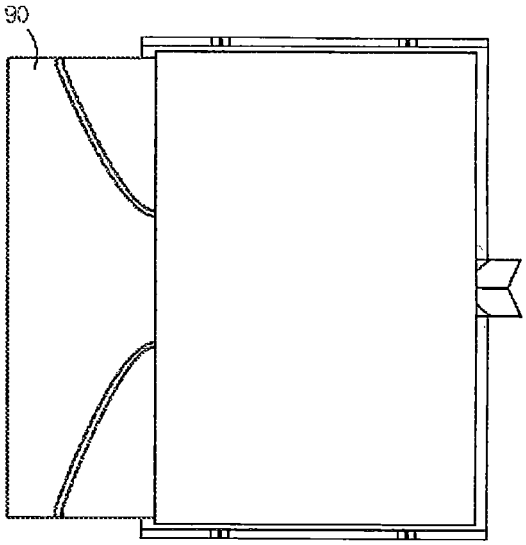
FIG. 4A is a schematic drawing showing the placing of a backup mask into the mask storing device in the open state.

Please refer to FIG. 4 and FIG. 4A, the storing unit 10*c* of the mask storing device 1*c* further comprises an interspace 17*c*, which is located between the inner surface 11*c* and the outer surface 12*c*, and provides a space for storage. The opening of the interspace 17*c* is located on one side of the mask storing device 1*c*. Users can use the space of the interspace 17*c* to place items, such as a spare mask 90, in case of emergencies.

Figure 5:
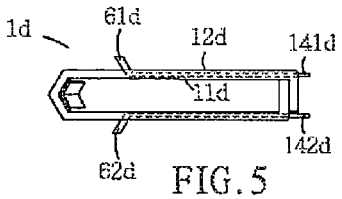
FIG. 5, FIG. 5A~FIG. 5C are schematic drawings showing the movable portion of the mask storing device is activated and the car loop is detached from the hook member.
Figure 5A:
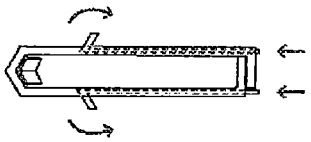
Figure 5B:
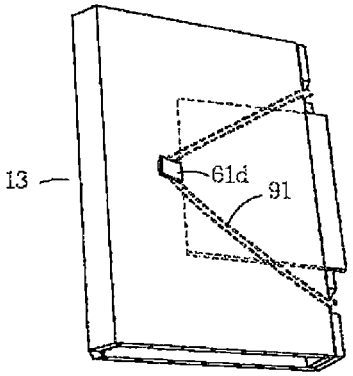
Figure 5C:
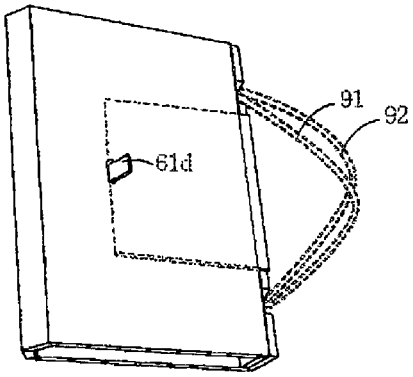

Please refer to FIG. 5 and FIGS. 5A~5C, the movable portion 141*d* and the movable portion 142*d* of the mask storing device 1*d* are located between the outer surface 12*d* and the inner surface 11*d* (as shown in FIG. 5), and the movable portion 141*d* and 142*d* can slide and move relatively to the outer surface 12*d* and drive the hook member 61*d* and the hook member 62*d* to change its directions (as shown in FIG. 5A). When the hook members 61*d* and 62*d* are oriented toward the bending portion 13, the ear loop 91 and the ear loop 92 attach to the hook member 61*d* and the hook member 62*d* (as shown in FIG. 5B). The user can press the movable portion 141*d* and 142*d* to drive the hook member 61*d* and the hook member 62*d* and change its directions, and make the ear loop 91 and the ear loop 92 detached. (as shown in FIG. 5C).

Figure 6:
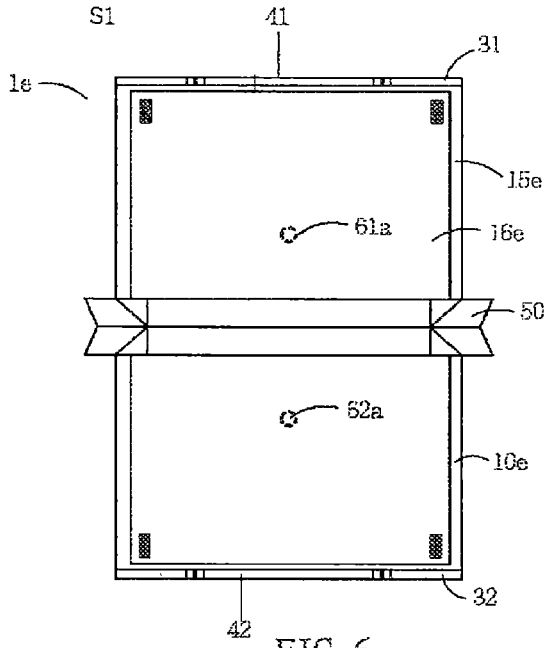
FIG. 6 provides an orthographic view of the mask storing device in the open state.
Figure 6A:
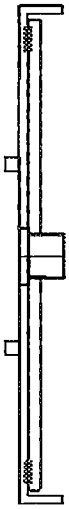
FIG. 6A provides a side view of the mask storing device in the open state.
Figure 6B:
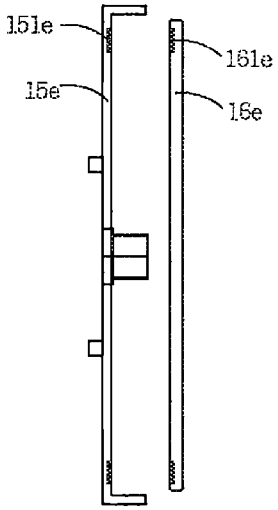
FIG. 6B is a schematic drawing showing the inner layer and the outer layer are detachable.
Figure 6C:
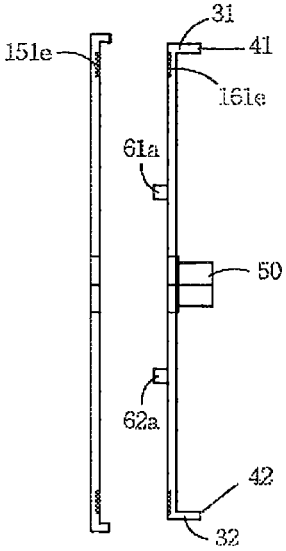
FIG. 6C is a schematic drawing showing different forms of the inner layer and the outer layer of the mask storing device.

Please refer to FIGS. 6 and 6A~6B, the storing unit 10*e* of the mask storing device 1*e* comprises an outer layer 15*e* and an inner layer 16*e*. In this embodiment, the inner layer 16*e* is detachably attached to the outer layer 15*e*. The outer layer 15*e* comprises a magnet 151*e* and the inner layer 16*e* comprises a magnet 161*e*. The outer layer 15*e* and the inner layer 16*e* are combined by the magnet 151*e* and the magnet 161*e*. The user can separate the outer layer 15*e* from the inner layer 16*e* and clean the outer layer 15*e* and the inner layer 16*e* individually. Or the material of the inner layer 16*e* and the outer layer 15*e* can be different and assembled together, such that it can enhance the product quality, increase variety of the appearance, or replace the damaged parts to extend product life. The assembly method of the outer layer 15*e* and the inner layer 16*e* is not limited to magnets, as long as the outer layer 15*e* and the inner layer 16*e* can be assembled and separated, for example, the effect of assembly and disassembly can be achieved by means of snaps, static electricity, hook and loop tape, etc. In addition, other components of the mask storing device 1*e*, such as the stopper member 31, the stopper member 32, the positioning member 41, the positioning member 42, the flexible stopper member 50, the hook member 61*a*, and the hook member 62*a* can be set on the outer layer 15*e* or the inner layer 16*e* respectively according to requirements. (FIG. 6C)

Figure 7:
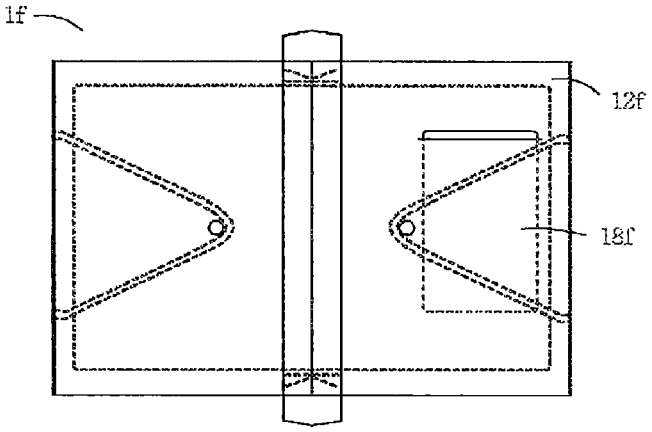
FIG. 7 provides a back view of the mask storing device.
Figure 8:
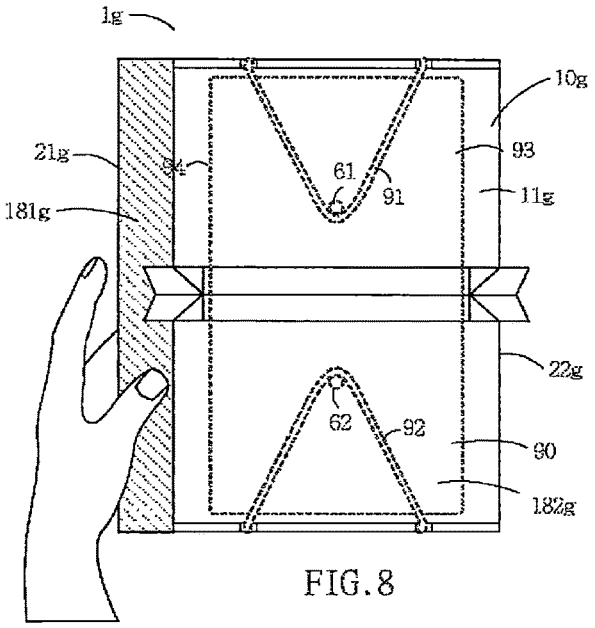
FIG. 8 provides an orthographic view showing holding the mask storing device for storing a mask.
Figure 8A:
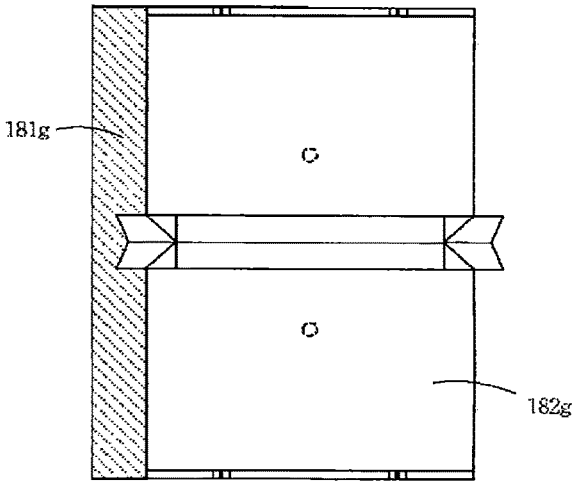
FIG. 8A provides an orthographic view of the mask storing device.
Figure 8B:
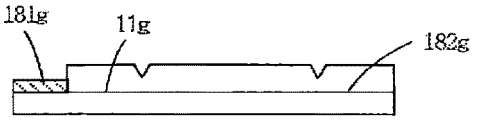
FIG. 8B provides a front view of the mask storing device.
Figure 8C:
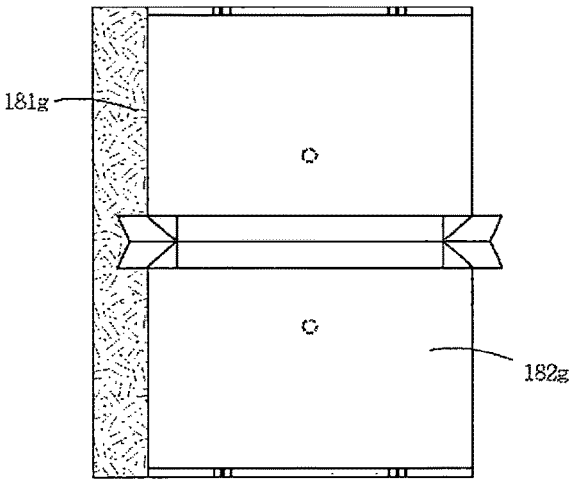
FIG. 8C~FIG. 8D are schematic drawings showing different forms of the handheld portion of the mask storing device.
Figure 8D:
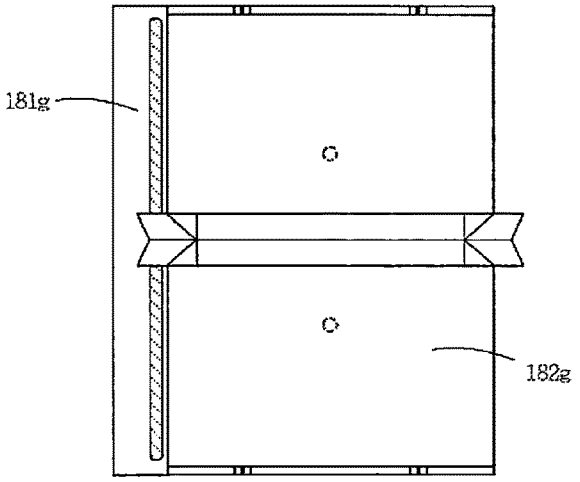
Figure 9:
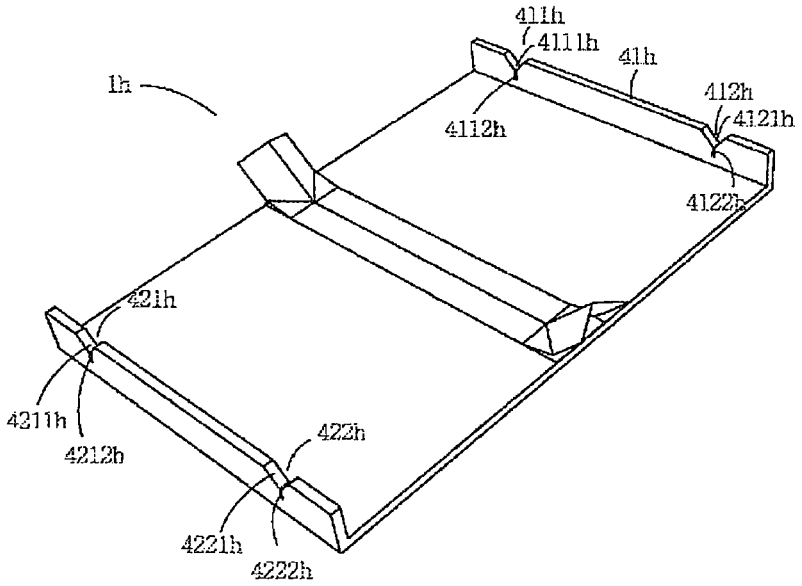
FIG. 9 provides a perspective view of the mask storing device in the open state.
Figure 9A:
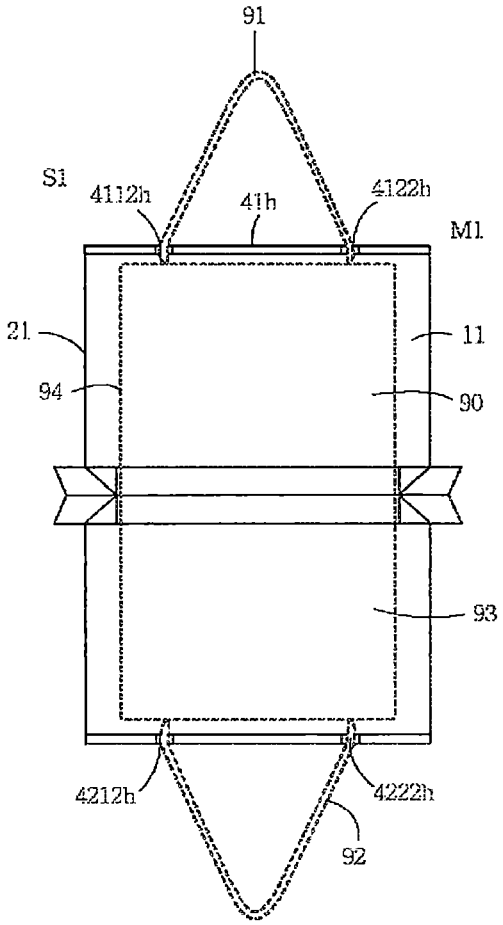
FIG. 9A~FIG. 9D are schematic drawings showing the process of the mask storing device transitions from the open state to the closed state and the method of storing a mask.
Figure 9B:
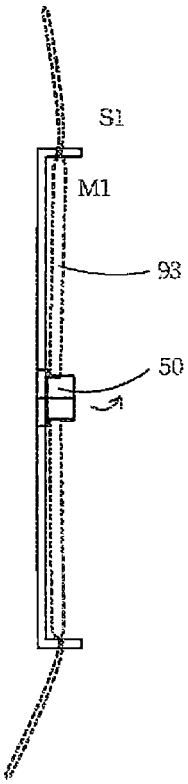
Figure 9C:
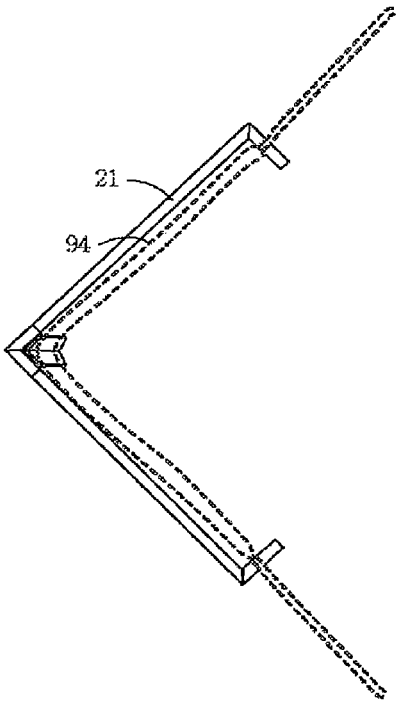
Figure 9D:
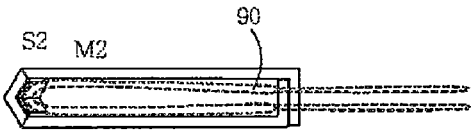

Please refer to FIG. 7, the mask storing device if further comprises a pocket 18*f* located on the outer surface 12*f*. The user can put items such as induction cards, ID cards, alcohol swabs, etc. in the pocket 18*f*. It makes the mask storing device 1*f* be able to be used in more different scenarios and increases the convenience. It should be noted that the outer surface 12*f* may have several pockets 18*f*, or the pockets 18*f* may also be located on the inner surface 11.

Please refer to FIGS. 8 and 8A to 8D, in the mask storing device 1*g*, the storing unit 10*g* further comprises a mask placement portion 182*g*, located on the inner surface 11 for placing the mask 90, and a handheld portion 181*g*, located next to the mask placement portion 182*g*. When the ear loop 91 and the ear loop 92 are attached to the hook member 61 and the hook member 62 and the mask 90 is located on the inner surface 11*g*, the mask body 93 is located in the mask placement portion 182*g*, the handheld portion 181*g* is located on the lengthwise side 21*g*. The function of the handheld portion 181*g* is to provide an area separated from the placement portion of the mask 90 for the user to conveniently hold the mask storing device 1*g*, and to prevent the user from touching the mask placement portion 182*g*, reducing the probability of touching germ from the inner surface 11*g*. In this embodiment, the handheld portion 181*g* is a protrusion higher than the inner surface 11*g* (as in FIG. 8B), but it can also be an area with different patterns, materials, colors, qualities or textures from the mask placement portion 182*g* (as in FIG. 8C), or the handheld portion 181*g* and the mask placement portion 182*g* can be divided by a raised area on the inner surface 11*g* (as in FIG. 8D), or the handheld portion 181*g* can be divided by the flexible stopper member 50, as long as the user can distinguish between the handheld portion 181*g* and mask placement portion 182*g*. It should be noted that the handheld portion 181*g* can also be located on both the lengthwise sides 21*g* and 22*g* (not shown in the figures), so that the user can hold the mask storing device more securely when they want to use it with both hands.

Please refer to FIGS. 9 and 9A~9D, the mask storing device 1*h* does not have the hook member 61*a* and the hook member 62*a* as shown in FIG. 2, but the hooking notch 411*h*, the hooking notch 412*h*, the hooking notch 421*h*, and the hooking notch 422*h* comprise the guiding notch 4111*h*, the guiding notch 4121*h*, the guiding notch 4211*h*, the guiding notch 4221*h*, the fastening notch 4112*h*, the fastening notch 4122*h*, the fastening notch 4212*h*, and the fastening notch 4222*h*. The hooking notch 4111*h*, the hooking notch 412*h*, the hooking notch 421*h*, the fastening notch 4112*h* of the hooking notch 422*h*, the fastening notch 4122*h*, the fastening notch 4212*h* and the fastening notch 4222*h* are attaching elements for attaching the ear loop 91 and the ear loop 92. And in the open state S1, the user can use the same method as described in the preceding embodiment to hold the mask storing device 1*h* and the mask 90 in portrait direction, then align the lengthwise edge 94 of the mask 90 with the lengthwise side 21 of the mask storing device 1*h*, and place the mask body 93 of the mask 90 on the mask storing device 1*h*. The user can grab the ear loop 91 and attach the ear loop 91 to both sides of the positioning member 41*h*, and fasten the ear loop 91 of the mask 90 on the attaching elements of the mask storing device 1, namely the fastening notch 4112*h* and the fastening notch 4122*h*. The user can also attach the ear loop 92 to the fastening notch 4212*h* and the fastening notch 4222*h*, flatten the mask 90 to the unfolded state M1 by pulling the ear loop 92 (as in FIG. 9A). When the mask 90 is positioned on the inner surface 11, the user can press down the flexible stopper member 50 to secure the mask body 93 (as in FIG. 9B), and fold the lengthwise edge 21 of the mask storing device 1 and the lengthwise edge 94 of the mask 90 in half (as in FIG. 9C), so that the mask storing device 1*h* transitions from the open state S1 to the closed state S2, and the mask 90 transitions from the unfolded state M1 to the folded state M2 (as in FIG. 9D) and reduce the size for easy carrying. Although the absence of the hook member 61 and the hook member 62 will allow the ear loop 91 and the ear loop 92 to be suspended outside the mask storing device 1*h*, but since the flexible stopper member 50 has pressed the mask body 93 down and the ear loop 91 and the ear loop 92 are fastened, the mask 90 will not be separated from the mask storing device 1*h*, and the effect of storing the mask 90 can still be achieved.

Figure 10:
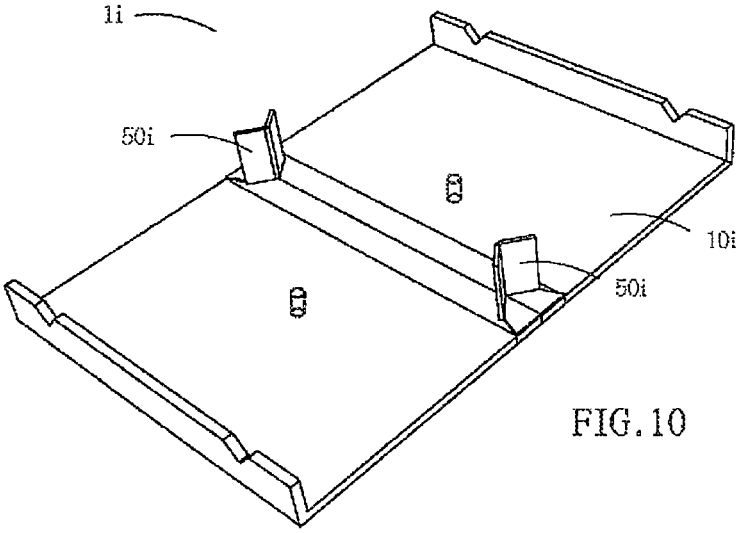
FIG. 10 provides a perspective view of the mask storing device in the open state.
Figure 10A:
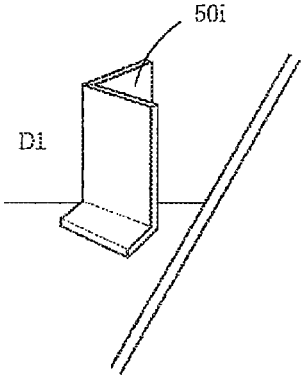
FIG. 10A~FIG. 10C are schematic drawings showing the positions of the flexible stopper member of the mask storing device.
Figure 10B:
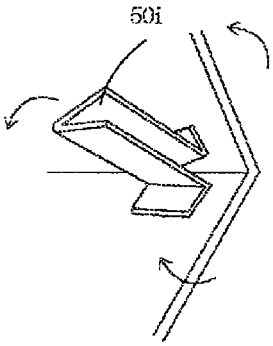
Figure 10C:
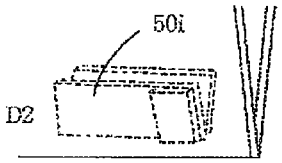

Please refer to FIGS. 10~10C. The flexible stopper member 50*i* is an origami structure and its positions comprise the positions D1 and D2. In the closing process of the storing unit 10*i*, the flexible stopper member 50*i* will transition from the position D1 to the position D2; in the opening process of the storing unit 10*i*, the flexible stopper member 50*i* will transition from the position D2 to the position D1.

Figure 11:
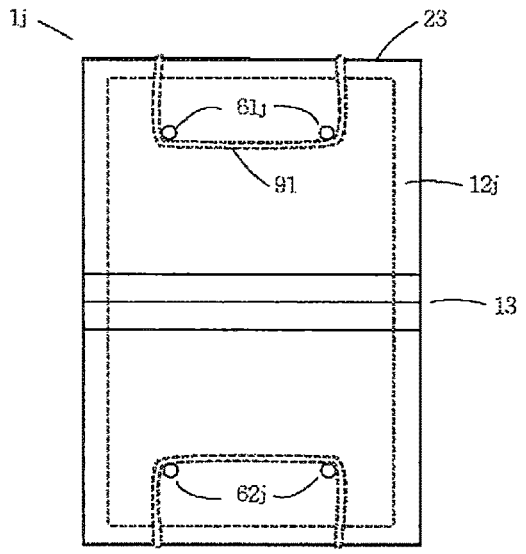
FIG. 11 provides a back view of the mask storing device in the open state.

Please refer to FIG. 11, the hook member 61*j* is located between the widthwise side 23 and the bending portion 13. The hook member 61*j* is two short posts located on the outer surface 12*j*, and is an attaching element for attaching the ear loop 91, and the hook member 62*j* is located on the opposite side of it. Although the hook member 61*j* is relatively close to the widthwise side 23, the ear loop 91 can still be fastened on the hook member 61*j* without loosening due to the sufficient distance between the two short posts.

Figure 12:
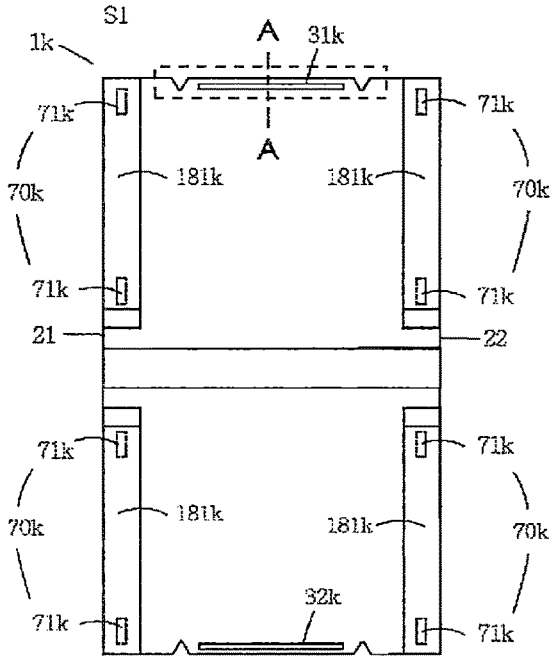
FIG. 12 provides an orthographic view of the mask storing device in the open state.
Figure 12A:
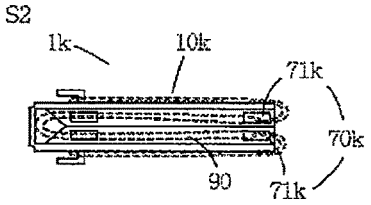
FIG. 12A provides a side view of the mask storing device in the closed state.
Figure 12B:
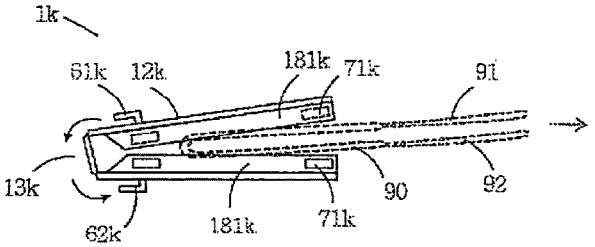
FIG. 12B is a schematic drawing showing the method of taking out a mask from the mask storing device.
Figure 12C:
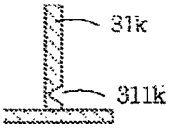
FIG. 12C is a section view along line A-A of FIG. 12 of the stopper portion of the mask storing device.
Figure 12D:
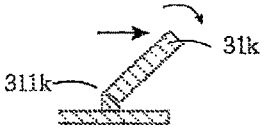
FIG. 12D is a section view along the line A-A of FIG. 12 of the stopper portion of the mask storing device.

Please refer to FIGS. 12~12B, there are two sets of the handheld portion 181*k*, located on the lengthwise sides 21 and 22 of the mask storing device 1*k* respectively. The mask storing device 1*k* comprises a closing component 70*k*, and the closing component 70*k* consists of several magnets 71*k* in this embodiment, located close to the lengthwise sides 21 and 22 in the handheld portion 181*k*. When the mask storing device 1*k* is folded in half, the magnets 71*k* attract each other, so that the mask storing device 1*k* is kept in the closed state S2 for carrying (FIG. 12A). When the mask 90 is placed in the mask storing device 1*k* in the closed state S2, the user can push the bending portion 13*k* or the outer surface 12*k* to move the bent portion 13*k*, so that the magnets 71*k* are offset from each other, weakening the pull force and releasing the closing component 70*k*, and opening the mask storing device 1*k*. After the user removes the ear loop 91 and the ear loop 92 from the attaching elements such as the hook member 61*k* and 62*k*, the user can easily and quickly grab the ear loop 91 or 92 and take out the mask 90 (FIG. 12B). Pushing and moving both sides of the bending portion 13*k* or the area close to the bending portion 13*k* on the outer surface 12*k* can make the mask storing device 1*k* open more widely, which is more convenient for taking out the mask 90. The user can also push elements connected to the outer surface 12*k* such as the hook member 61*k* and 62*k* to achieve the same effect. If the closing force of the closing component 70*k* is weak, for example, if the pulling force of the magnet 71*k* is weak, or the closing component 70*k* uses other methods such as elastic cords to close the unit the user can also directly grab the ear loop 91 or 92 and pull the mask 90, using the pulling force to release the closing component 70*k* and directly take out the mask 90. The magnet 71*k* can also maintain the closed state S2 by attracting other magnetic substances. The closing component 70*k* can be located at different parts of the mask storing device 1*k*, such as the stopper portion 31*k*, the stopper portion 32*k*, the inner surface 11*k*, the outer surface 12*k*, or the vicinity of the bending portion 13*k* (not shown in the figure), and the storing unit 10*k* can be kept closed by means different from magnetic attraction, such as snaps, straps, or elastic cords over the box body, etc., as long as the mask storing device 1*k* can be kept in the closed state S2. And if the closing component 70*k* can be released and the mask storing device 1*k* can be opened by moving the bending portion 13*k* or the outer surface 12*k*, the mask 90 can be taken out in the same way. In this embodiment, the area where the stopper portions 31*k* and 32*k* are connected to the inner surface 11*k* has a notch and a thin portion to form a flexible hinge 311*k* (FIG. 12C). If the mask 90 touches the stopper member 31*k* or 32*k* when the user pulls out the mask 90, the stopper members 31*k* or 32*k* can be bent along the flexible hinge 311*k* (FIG. 12D), so that the mask 90 has a larger space to be pulled out smoothly and restored to its original state by the elasticity of the material after the external force is removed. (FIG. 12C). In case that the closing component 70*k* is not released, the mask 90 can also be removed from the storing unit 10*k* if there is enough space while the flexible stopper members 31*k* and 32*k* are bent. The stopper member 31*k* or 32*k* can be made of flexible materials, such as plastic, elastomer or silicone rubber, etc., as long as the stopper member 31*k* or 32*k* can be bent and return to its original state. The effect may be achieved without the flexible hinge 311*k* if the material is flexible enough.

In the above-mentioned embodiments, the multiple hook members of the mask storing device can be in different forms, as long as the ear loops can be attached to them; the multiple positioning members can be in different forms, as long as the ear loops can be guided to position. The multiple stopper members can be of different forms, as long as they can provide support for the mask or prevent it from protruding out of the mask storing device; the multiple flexible stopper members can be in different forms, as long as the mask can be blocked or pressed.

In the above-mentioned embodiments, the material of the storing unit can be metal, non-metal such as plastic, rubber, fabric, paper, leather, etc., or other materials.

It should be noted that the above-mentioned embodiments are only illustrative of the principles and effects of the present invention, and are not intended to limit the scope of the present invention. Anyone skilled in the art can make modifications and variations to the embodiments without departing from the technical principles and spirit of the present invention. The protection scope of the present invention should be as described in the claims and their equivalents of the patent application.

COMPONENTS mask storing device 1,1*a*,1*b*,1*c*,1*d*,1*e*,1*f*,1*g*,1*h*,1*i*,1*k*
storing unit 10,10*b*,10*c*,10*e*,10*g*,10*i*,10*k*
inner surface 11,11*b*,11*c*,11*d*,11*g*,11*k*
outer surface 12,12*c*,12*d*,12*f*,12*k*
pocket 18*f*
bending portion 13,13*b*,13*k*
movable portion 141,142,141*d*,142*d*
outer layer 15*e*
inner layer 16*e*
magnet 151*e*,161*e*,71*k*
interspace 17*c*
handheld portion 181*g*,181*k*
mask placement portion 182*g*
lengthwise side 21,22,21*g*,22*g*
widthwise side 23,24,23*b*
stopper portion 31,32,31*b*,31*k*,32*k*
flexible hinge 311*k*
positioning member 41,42,41*b*,41*h*
hooking notch 411,412,421,422,411*b*,412*b*,411*h*,412*h*,421*h*,422*h*
guiding notch 4111*b*,4121*b*,4111*h*,4121*h*,4211*h*,4221*h*
fastening notch 4112*b*,4122*b*,4181*h*,4122*h*,4212*h*,4222*h*
flexible stopper member 50,50*b*,50*i*
position A1,A2,A2',B1,B2,B2',C1,C2,D1,D2
hook member 61,61*a*,62*a*,61*d*,62*d*,61*j*,62*j*,61*k*,62*k*
closing component 70*k*
open state S1
closed state S2
mask 90
ear loop 91,92
mask body 93
lengthwise edge 94
unfolded state M1
folded state M2

What is claimed is:

1. A mask storing device, for storing a mask, the mask storing device comprises:

a storing unit, comprising an outer surface, an inner surface and a bending portion; and a hook member, located on the outer surface;

whereby, the mask can be placed on the inner surface, and an ear loop of the mask is exposed on the outer surface and attached to the hook member; the mask storing device has an open state and a closed state; in the open state, the inner surface and the outer surface are unfolded and the mask is in an unfolded state; in the closed state, a lengthwise side of the storing unit and a lengthwise edge of the mask are folded in half along the bending portion, the storing unit envelops a mask body of the mask, and the mask is in a folded state.

2. The mask storing device of claim 1, wherein the hook member is located in the bending portion, or between a widthwise side of the storing unit and the bending portion.

3. The mask storing device of claim 1, wherein the storing unit further comprises a movable portion, and the hook member is located at the movable portion.

4. The mask storing device of claim 1, further comprising:

another hook member, located on the outer surface, wherein the hook members are located on two opposite sides of the bending portion.

5. The mask storing device of claim 1, further comprising:

a positioning member, located on a widthwise side of the storing unit, for positioning an ear hoop of the mask.

6. The mask storing device of claim 5, wherein the positioning member comprises a hooking notch for hooking the ear loop.

7. The mask storing device of claim 5, wherein the positioning member is a protrusion, and the ear loop is hooked on two sides of the protrusion.

8. The mask storing device of claim 1, further comprising:

a stopper portion, located on a widthwise side of the storing unit.

9. The mask storing device of claim 8, wherein the stopper portion is bendable.

10. The mask storing device of claim 1, further comprising:

a flexible stopper member, located on the lengthwise side of the storing unit or the bending portion or next to the bending portion, for blocking the lengthwise edge of the mask.

11. The mask storing device of claim 10, wherein the flexible stopper member is at a first position when the storing unit is in an open state, and the flexible stopper member is at a second position when the storing unit is in a closed state.

12. The mask storing device of claim 11, wherein the flexible stopper member transits from the first position to the second position along with a closing process of the storing unit, or the flexible stopper member transits from the second position to the first position along with an opening process of the storing unit.

13. The mask storing device of claim 10, wherein the flexible stopper member does not block the mask when it is at a first position, and the flexible stopper member blocks the mask when it is at a second position.

14. The mask storing device of claim 13, wherein the flexible stopper member transits from the first position to the second position along with a closing process of the storing unit, or the flexible stopper member transits from the second position to the first position along with an opening process of the storing unit.

15. The mask storing device of claim 1, further comprising:

a closing component.

16. The mask storing device of claim 1, wherein the storing unit further comprises an outer layer and an inner layer.

17. The mask storing device of claim 1, wherein the storing unit further comprises an interspace between the inner surface and the outer surface.

18. The mask storing device of claim 1, wherein the storing unit comprises a handheld portion and a mask placement portion, the handheld portion and the mask placement portion are on the inner surface, the mask body is placed on the mask placement portion, and the handheld portion is on the lengthwise side of the storing unit.

* * * * *